US010323343B2

(12) United States Patent
Tsujimoto

(10) Patent No.: US 10,323,343 B2
(45) Date of Patent: Jun. 18, 2019

(54) WATER REMOVAL DEVICE FOR WATER JET LOOM

(71) Applicant: KABUSHIKI KAISHA TOYOTA JIDOSHOKKI, Kariya-shi, Aichi-ken (JP)

(72) Inventor: Koichi Tsujimoto, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 361 days.

(21) Appl. No.: 14/463,759

(22) Filed: Aug. 20, 2014

(65) Prior Publication Data

US 2015/0052772 A1 Feb. 26, 2015

(30) Foreign Application Priority Data

Aug. 26, 2013 (JP) ..... 2013-174732

(51) Int. Cl.
*D03D 47/32* (2006.01)
*F26B 5/12* (2006.01)
*F26B 5/14* (2006.01)

(52) U.S. Cl.
CPC ..... *D03D 47/32* (2013.01); *F26B 5/12* (2013.01); *F26B 5/14* (2013.01)

(58) Field of Classification Search
CPC ..... F26B 5/12; F26B 5/14; D03D 47/32
See application file for complete search history.

(56) References Cited

FOREIGN PATENT DOCUMENTS

| | | | |
|---|---|---|---|
| CN | 1479818 | A | 3/2004 |
| CN | 1724736 | A | 1/2006 |
| CN | 202227051 | U | 5/2012 |
| CN | 202898703 | U | 4/2013 |
| JP | 59-15543 | A | 1/1984 |
| JP | 6-79784 | U | 11/1994 |
| JP | 2005-042255 | A | 2/2005 |
| JP | 2005120518 | A | 5/2005 |
| JP | 2008179905 | A | 8/2008 |

OTHER PUBLICATIONS

Communication dated Sep. 18, 2015, issued by the State Intellectual Property Office of the P.R.C. in corresponding Chinese Application No. 201410416304.6.
Communication dated Jan. 26, 2016, from the Japanese Patent Office in counterpart application No. 2013-174732.

*Primary Examiner* — Jessica Yuen
(74) *Attorney, Agent, or Firm* — Sughrue Mion, PLLC

(57) ABSTRACT

A water removal device for a water jet loom includes a suction member. A cloth route is formed between a cloth fell of a cloth and a surface roller of the jet loom. The suction member is arranged at the cloth route and removes water from a lower side of the cloth. Between a location proximate to the cloth fell and the suction member, the cloth route forms an ascending slope from the location proximate to the cloth fell to the suction member.

5 Claims, 4 Drawing Sheets

WATER REMOVAL DEVICE FOR WATER JET LOOM

BACKGROUND OF THE INVENTION

The present invention relates to a water removal device for a water jet loom.

A cloth is wet when woven by a water jet loom. Thus, water needs to be removed from the cloth. For this reason, a water jet loom includes a water removal device to remove water from the cloth. The water removal device of a water jet loom includes a suction member that removes water from a cloth in a cloth route between the cloth fell and a surface roller. The suction member includes a slit. A blower is connected to the suction member. When the blower is operated, a suction flow is produced at the slit of the suction member. Then, the surface roller is rotated to pull the cloth toward the surface roller. As the cloth moves above the slit of the suction member, the suction member draws in water from the wet cloth.

However, when the cloth has a high weaving density, water flows along the upper surface of the cloth toward the surface roller. This makes it difficult for the suction member to draw in water from the cloth and lowers the efficiency for removing water from the cloth.

Accordingly, Japanese Laid-Open Patent Publication No. 2005-42255 describes a structure that impedes the flow of water on the upper surface of a cloth toward the surface roller. The water removal device of the water jet loom described in the publication includes a guide bar. The guide bar is located between the cloth fell and a main suction tube (suction member) and extends to a position that is higher than a horizontal plane (warp line) lying along a direction extending through the cloth fell of a cloth and the uppermost portion of a main suction tube. The guide bar supports the cloth from a lower side. Thus, the cloth route between the cloth fell and the main suction tube is peak-shaped as viewed from a weaving widthwise direction of the cloth. The peak-shaped cloth route decreases the amount of water on the upper surface of the cloth that flows toward the main suction tube, that is, toward the surface roller.

However, in the water removal device of the water jet loom described in the above publication, the cloth route is peak-shaped. Thus, when the water on the upper surface of the cloth in the portion of the cloth route ascending toward the peak moves beyond the peak of the cloth route, the water may flow down the portion of the cloth route descending from the peak toward the main suction tube. This would lower the water removal efficiency.

SUMMARY OF THE INVENTION

It is an object of the present invention to provide a water removal device for the water jet loom that improves the efficiency for removing water from a cloth.

To achieve the above object, one aspect of the present invention is a water removal device for a water jet loom. A cloth route is formed between a cloth fell of a cloth and a surface roller of the water jet loom. The water removal device includes a suction member that is arranged at the cloth route and removes water from a lower side of the cloth. Between a location proximate to the cloth fell and the suction member, the cloth route forms an ascending slope from the location proximate to the cloth fell to the suction member.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

One embodiment of a water removal device for a water jet loom will now be described with reference to FIGS. 1 to 3.

Figure 1:
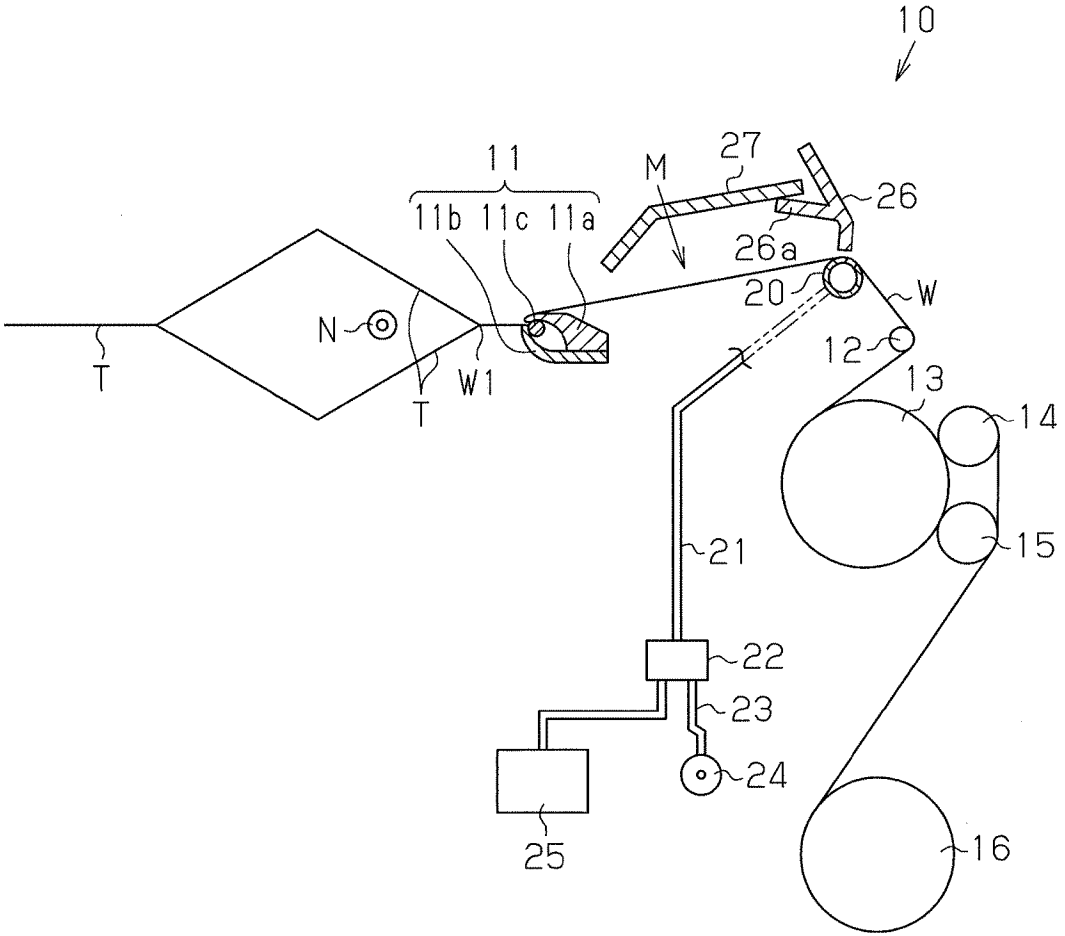
FIG. 1 is a schematic diagram showing a water removal device of a water jet loom according to one embodiment of the present invention.

Referring to FIG. 1, a water jet loom includes a water removal device 10, a bar temple 11, a breast bar 12, a surface roller 13, two press rollers 14 and 15, and a cloth roller 16. Water is ejected from a weft insertion nozzle N so that a weft is inserted into a warp T to weave a cloth W. The cloth W runs along the bar temple 11, the breast bar 12, the surface roller 13, and the two press rollers 14 and 15 and is wound around the cloth roller 16.

Figure 2:
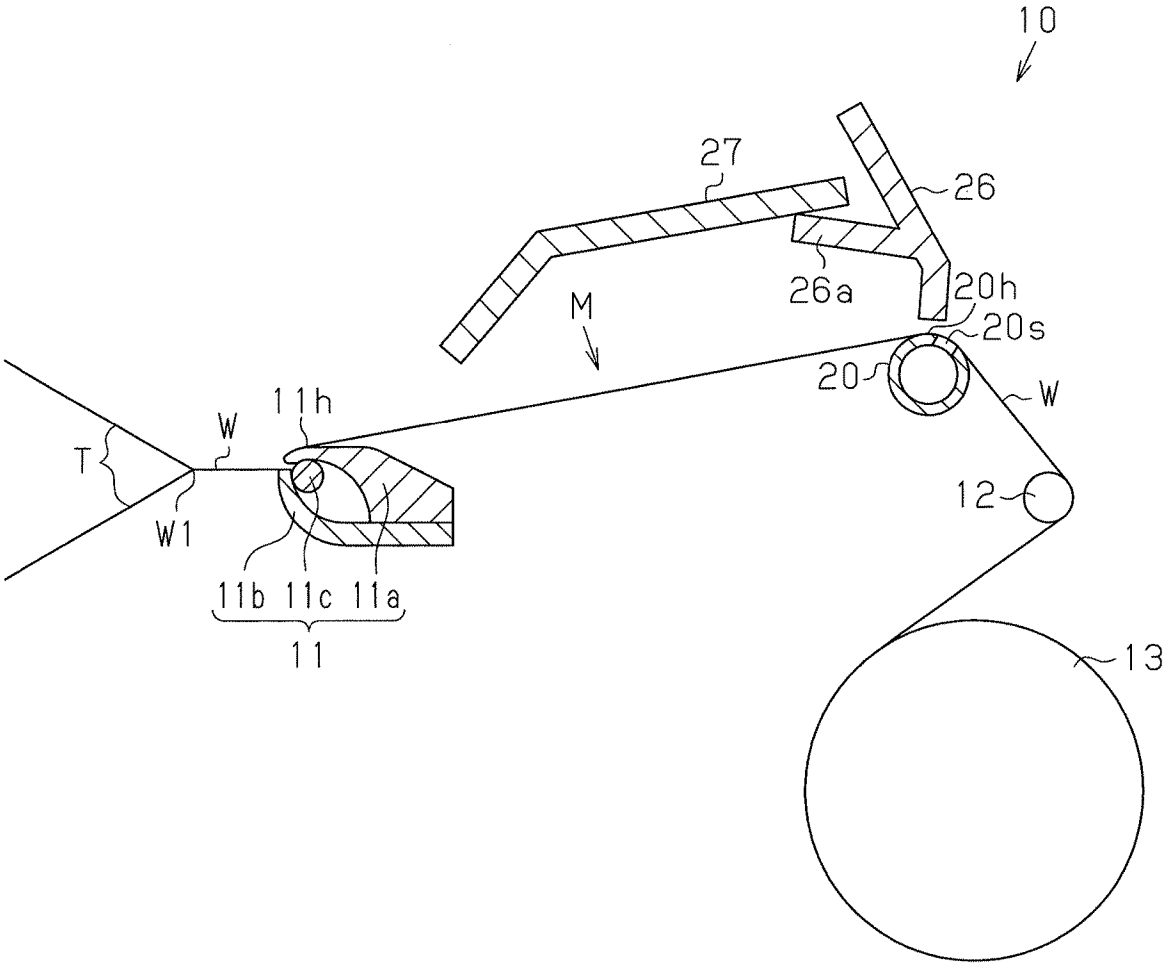
FIG. 2 is a schematic diagram showing a portion of the water removal device of FIG. 1.

Referring to FIG. 2, a cloth route M is formed between a cloth fell W1 and the surface roller 13. The bar temple 11 is located proximate to the cloth fell W1 in the cloth route M. The bar temple 11 includes upper and lower guide bars 11*a* and 11*b* and a spindle 11*c*. The two guide bars 11*a* and 11*b* extend throughout the entire weaving width of the cloth W. The spindle 11*c* is located between the two guide bars 11*a* and 11*b* and extends throughout the entire weaving width of the cloth W. The cloth W is held between the guide bars 11*a* and 11*b* and the spindle 11*c* to limit weaving shrinkage so that the cloth W has a high density. Further, the water removal device 10 includes a suction tube 20 that serves as a suction member and removes water from the cloth W at the lower side of the cloth W in the cloth route M.

Figure 3:
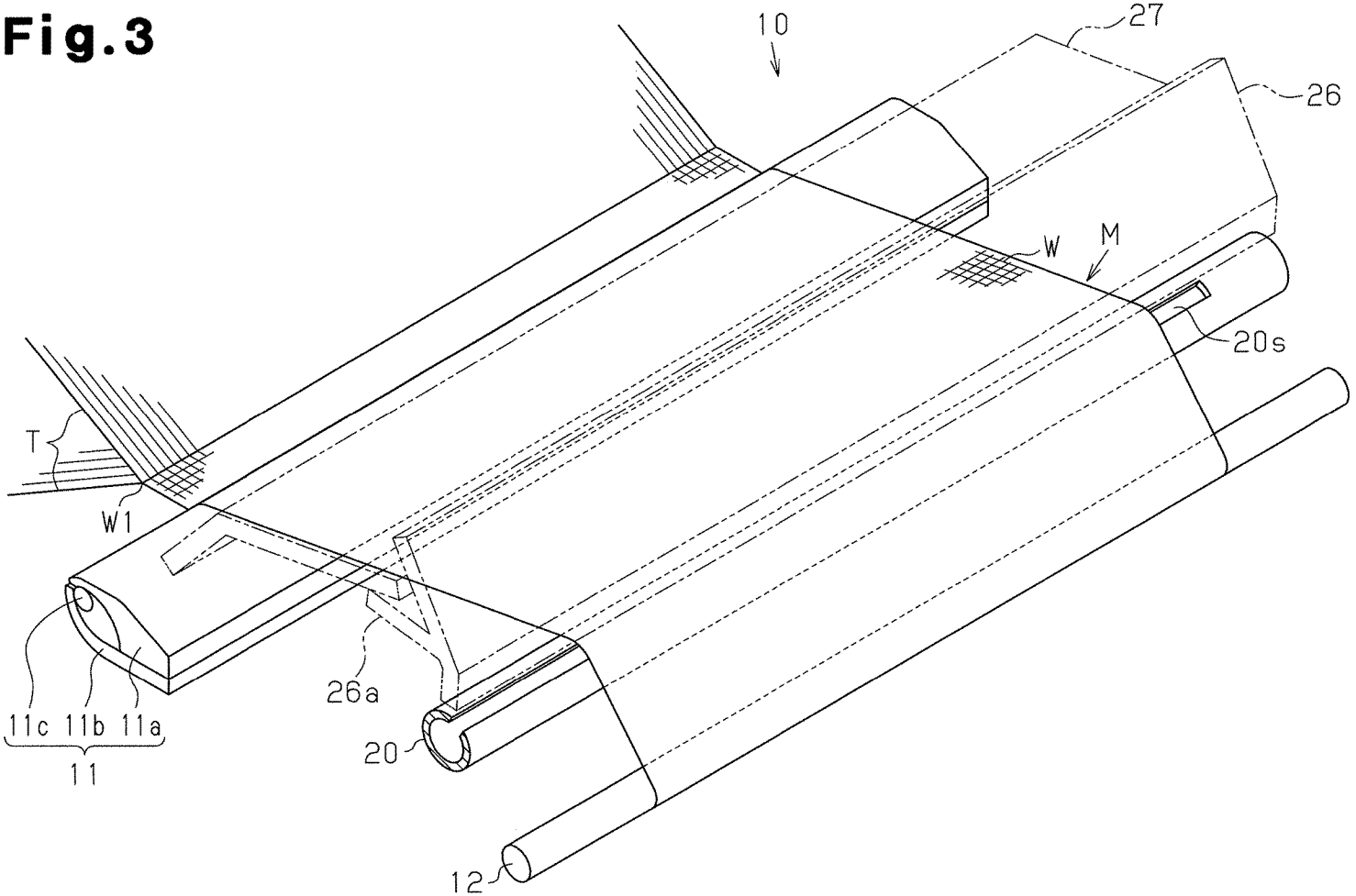
FIG. 3 is a perspective view showing a portion of the water removal device of FIG. 2.

As shown in FIG. 3, the suction tube 20 is tubular and has a length allowing the suction tube 20 to entirely contact the cloth at least in the weaving widthwise direction. The suction tube 20 includes a slit 20*s*. The slit 20*s* has a length set so that the slit 20*s* entirely faces the cloth W in the weaving widthwise direction.

Referring to FIG. 2, the cloth W is in contact with the uppermost portion 20*h* of the suction tube 20 when guided toward the surface roller 13. The suction tube 20 is set so that the uppermost portion 20*h* is located at a higher position than the uppermost portion 11*h* of the bar temple 11 (uppermost portion of guide bar 11*a*). More specifically, the uppermost portion 20*h* is set at a position that is higher in the vertical direction than the uppermost portion 11*h* of the bar temple 11. Thus, between the uppermost portion 11*h* and the suction tube 20, the cloth route M forms a slope that ascends from the uppermost portion 11*h* of the bar temple 11 to the suction tube 20. That is, between a location proximate to the cloth fell W1 and the suction tube 20, the cloth route M forms an ascending slope from the location proximate to the cloth fell W1 to the suction tube 20.

As shown in FIG. 1, a pipe 21, an air-water separator 22, and a pipe 23 connect the suction tube 20 to a blower 24. When the blower 24 is operated, a suction flow is produced at the slit 20*s* of the suction tube 20. A water tank 25 is connected to the air-water separator 22.

A water-resistant plate 26 is located above the suction tube 20. An auxiliary plate 26*a* is formed integrally with the inner side of the upper portion of the water-resistant plate 26. A cover 27 is located above the cloth route M. The water-resistant plate 26 and the cover 27 cover the cloth route M from a location proximate to the bar temple 11 to the suction tube 20.

The operation of the present embodiment will now be described.

When the cloth W has a high weaving density, water flows along the upper surface of the cloth W between the cloth fell W1 and the surface roller 13. The water on the upper surface of the cloth W flows toward the surface roller 13. However, between the uppermost portion 11*h* of the bar temple 11 and the suction tube 20, a slope is formed ascending from the uppermost portion 11*h* of the bar temple 11 to the suction tube 20. That is, the cloth route M from a location proximate to the cloth fell W1 to the suction tube 20 is an ascending route. Thus, the water on the upper surface of the cloth W does not flow toward the surface roller 13. This prevents water on the upper surface of the cloth W from flowing to the surface roller 13.

When water is ejected from the weft insertion nozzle N to perform weft insertion, that is, when weaving the cloth W, the blower 24 is operated to produce a suction flow at the slit 20*s* of the suction tube 20. The cloth W, which is drawn to the surface roller 13 by the rotation of the surface roller 13, is subject to the suction action of the suction tube 20. This draws water from the cloth W into the suction tube 20. Here, the cloth route M is an ascending route from a location proximate to the cloth fell W1 to the suction tube 20. Thus, the water on the upper surface of the cloth W does not flow toward the surface roller 13. This improves the efficiency for removing water from the cloth. The air-water separator 22 separates air from the water drawn into the suction tube 20 and then sends the water to the water tank 25.

The embodiment has the advantages described below.

(1) The cloth route M is an ascending slope from a location proximate to the cloth fell W1 to the suction tube 20. Thus, the cloth route M is an ascending route from the location proximate to the cloth fell W1 to the suction tube 20. Consequently, the water on the upper surface of the cloth W does not flow toward the surface roller 13. This improves the efficiency for removing water from the cloth W.

(2) The bar temple 11 is arranged at a location proximate to the cloth fell W1 in the cloth route M. The bar temple 11 holds the cloth W over the entire width of the cloth W. Thus, an ascending slope may be formed with the cloth route M just by positioning the suction tube 20 at a higher location than the bar temple 11.

(3) To prevent water on the upper surface of the cloth W from flowing toward the surface roller 13, for example, a damming member may be used to dam the flow of water on the upper surface of the cloth W. Alternatively, an aiding member that aids the suction of water into the suction tube 20 may be used to press the cloth W in the vicinity of the suction tube 20. However, such a damming member or aiding member would contact the cloth W. This would result in foreign matter, such as adhesive residues or thread oil, collecting on the portion of the cloth W where contact occurs with the damming member or the aiding member. In the present embodiment, there is no need for the damming member and the aiding member. Thus, the quality of the cloth W remains unaffected.

It should be apparent to those skilled in the art that the present invention may be embodied in many other specific forms without departing from the spirit or scope of the invention. Particularly, it should be understood that the present invention may be embodied in the following forms.

Figure 4:
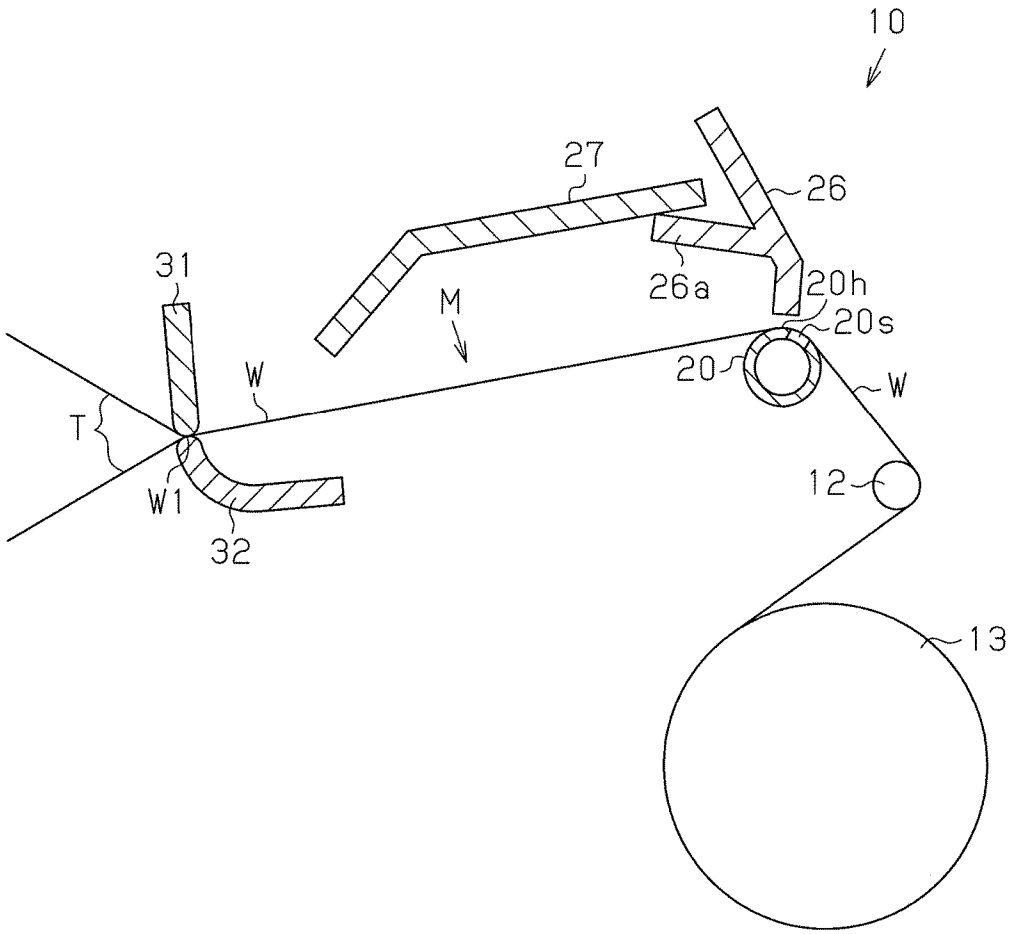
FIG. 4 is a schematic diagram showing a portion of a water removal device in a further embodiment.

Referring to FIG. 4, when using a known ring temple at a location proximate to the end of the cloth fell W in lieu of the bar temple 11, a pressing member 31 may be used to press the cloth W against the cloth fell W1. Although the pressing member 31 only needs to press the middle of the cloth W where the cloth W is not held by the ring temple (not shown), the pressing member 31 of the present embodiment presses the cloth W over the entire width. The cloth W is pressed and held between the pressing member 31 and a fell plate 32. In the embodiment of FIG. 4, the pressing member 31 presses the cloth fell W1. However, the location where the cloth fell W is pressed does not necessarily have to be the same. Further, between the location where the cloth W is pressed, that is, the pressing location of the pressing member 31 (cloth fell W1), and the suction tube 20, the cloth route M forms an ascending slope from the location where the cloth W is pressed to the suction tube 20. When using the ring temple, the cloth W is not constrained at the middle. Thus, when only positioning the suction tube 20 at a location higher than the cloth weft W1, the cloth route M cannot form an ascending slope at the middle of the cloth W. However, by pressing the middle of the cloth W with the pressing member 31, an ascending slope can be formed in the cloth route M over the entire width of the cloth W.

In the above embodiments, the suction tube 20 may be shorter than the width of the cloth W in the weaving direction. In this case, the slit 20*s* may be shorter than the width of the cloth W in the weaving direction.

In the above embodiments, for example, the suction tube 20 may include a plurality of holes that produce a suction flow, and water may be drawn into the holes from the cloth W.

In the above embodiments, the suction tube 20 may be a tetragonal tube, a triangular tube, or the like.

The present examples and embodiments are to be considered as illustrative and not restrictive, and the invention is not to be limited to the details given herein, but may be modified within the scope and equivalence of the appended claims.

What is claimed is:

1. A water removal device for a water jet loom, a cloth route starting at a cloth fell of a cloth and extending to a surface roller of the water jet loom, the water removal device comprising:

a bar temple that holds the cloth and is arranged at the cloth route proximate to the cloth fell;

a suction tube that is arranged at the cloth route and removes water from a lower side of the cloth; and a water-resistant plate and a cover that are arranged to cover a part of the cloth route that extends from the bar temple to the suction tube, wherein the suction tube is located at a portion of the cloth route that is covered by the water-resistant plate, wherein the portion of the cloth route that is covered by the water-resistant plate is located at a higher position than an uppermost portion of the bar temple so that an ascending slope is formed from the bar temple to the portion of the cloth route that is covered by the water-resistant plate, in all of the part of the cloth route that is covered by the water-resistant plate and the cover, the cloth route forms the ascending slope, and a number of the suction tube that is arranged at the cloth route between the cloth fell and the surface roller is a total of one.

2. The water removal device according to claim 1, wherein the suction tube is arranged so that the uppermost portion of the suction tube is located at a higher position than the uppermost portion of the bar temple.

3. The water removal device according to claim 1, wherein the suction tube has a length over which the suction tube entirely contacts the cloth in at least a weaving widthwise direction.

4. The water removal device according to claim 1, wherein the suction tube includes a slit where a suction flow is produced, and the slit has a length over which the slit entirely faces the cloth in at least a weaving widthwise direction.

5. A water removal device for a water jet loom, a cloth route starting at a cloth fell of a cloth and extending to a surface roller of the water jet loom, the water removal device comprising:

a pressing member that presses the cloth and is arranged at the cloth route proximate to the cloth fell;

a suction tube that is arranged at the cloth route and removes water from a lower side of the cloth; and a water-resistant plate and a cover that are arranged to cover a part of the cloth route that extends from the pressing member to the suction tube, wherein the suction tube is located at a portion of the cloth route that is covered by the water-resistant plate, wherein the portion of the cloth route that is covered by the water-resistant plate is located at a higher position than a portion of the pressing member that contacts the cloth, so that an ascending slope is formed from the portion of the pressing member that contacts the cloth to the portion of the cloth route that is covered by the water-resistant plate, in all of the part of the cloth route is covered by the water-resistant plate and the cover, the cloth route forms the ascending slope, and a number of the suction tube that is arranged at the cloth route between the cloth fell and the surface roller is a total of one.

* * * * *